United States Patent [19]

Litt et al.

[11] Patent Number: 4,790,748

[45] Date of Patent: Dec. 13, 1988

[54] GRAIN DRYING METHOD AND APPARATUS UTILIZING FLUIDIZED BED

[75] Inventors: Robert B. Litt, London; John M. Corliss, Columbus, both of Ohio

[73] Assignee: Gwyer Grimminger, Grand Island, Nebr.

[21] Appl. No.: 38,312

[22] Filed: Apr. 14, 1987

[51] Int. Cl.[4] ..... F27B 15/00

[52] U.S. Cl. ..... 432/15; 432/58; 34/215; 34/57 R

[58] Field of Search ..... 34/57 R, 215; 432/58, 432/14, 15; 110/245

[56] References Cited

U.S. PATENT DOCUMENTS

| | | | |
|---|---|---|---|
| 4,253,825 | 3/1981 | Fasano | 34/215 |
| 4,324,544 | 4/1982 | Blake | 432/14 |
| 4,535,065 | 8/1985 | Klein et al. | 432/15 |
| 4,552,529 | 11/1985 | Brannstrom et al. | 432/58 |
| 4,629,419 | 12/1986 | Ward et al. | 432/58 |
| 4,682,948 | 7/1987 | Cohen | 432/58 |

*Primary Examiner*—Henry C. Yuen

*Attorney, Agent, or Firm*—Berman, Aisenberg & Platt

[57] ABSTRACT

A grain drying system includes a fluidized bed for burning grain dust. The hot gases produced by the combustion of the grain dust are directed to a cyclone for cleaning and then to a known grain dryer. The ashes or other particles removed from the hot gases by the cyclone are returned to the fluidized bed.

4 Claims, 3 Drawing Sheets

GRAIN DRYING METHOD AND APPARATUS UTILIZING FLUIDIZED BED

THE TECHNICAL FIELD

This invention relates to the art of drying grain. In particular, the invention relates to a grain drying apparatus wherein grain dust is burned with the assistance of a fluidized bed to produce hot gases for drying grain.

THE BACKGROUND ART

It is known to dry grain to enhance its storage characteristics. In a typical grain drying apparatus, oil or coal is burned to provide hot gases which are circulated throughout the grain to dry it. Such a process is expensive because of the high prices for coal or oil. U.S. Pat. No. 3,562,921 (Lindl) shows a grain dehydrator wherein an oil or gas furnace produces hot gases for drying the grain. A cyclone-type separator separates the dried grain from gaseous odors, which are then reburned for supplementing the hot gases from the furnace. The burning of agricultural waste products to produce heat is also known. U.S. Pat. No. 4,398,477 (Iwasaki) shows an apparatus for directing combustible material, such as the hulls of rice, to a furnace to produce a swirling flow of combustible products.

A fluidized bed is also known for combustion processes. U.S. Pat. Nos. 4,469,050 (Korenberg) and 4,378,744 (DeFeo et al.) show fluidized bed reactors for burning material. In each of these devices, the desired output heat is obtained by a heat exchanger in contact with the fluidized bed.

Cyclones are also known for use in separating gases from solid materials. U.S. Pat. No. 3,477,650 (Williams) shows such a device, as do the Korenberg, DeFeo et al. and Lindl patents.

SUMMARY OF THE INVENTION

In accordance with the invention, grain is dried with hot gases produced from burning grain dust. The grain dust is burned in a fluidized bed, and the hot gases from combustion are directed to a known grain dryer. Before introducing the combustion gases to the dryer, they are treated by a cyclone to remove ash, and the ash is returned to the fluidized bed.

The invention utilizes readily-available grain dust to produce the heat necessary to dry grain and is thus economical. The fluidized bed promotes complete combustion of the grain dust, and is highly advantageous.

An object of this invention is to provide a method and apparatus for using grain dust to produce hot gases for the drying of grain.

Another object of this invention is to combine grain dust with air in a fluidized bed for combustion.

Still another object of this invention is to remove ash from combustion gasses prior to introduction of the combustion gases to a grain dryer and to return the ash to a fluidized bed.

DETAILED DESCRIPTION OF THE INVENTION

Figure 1:
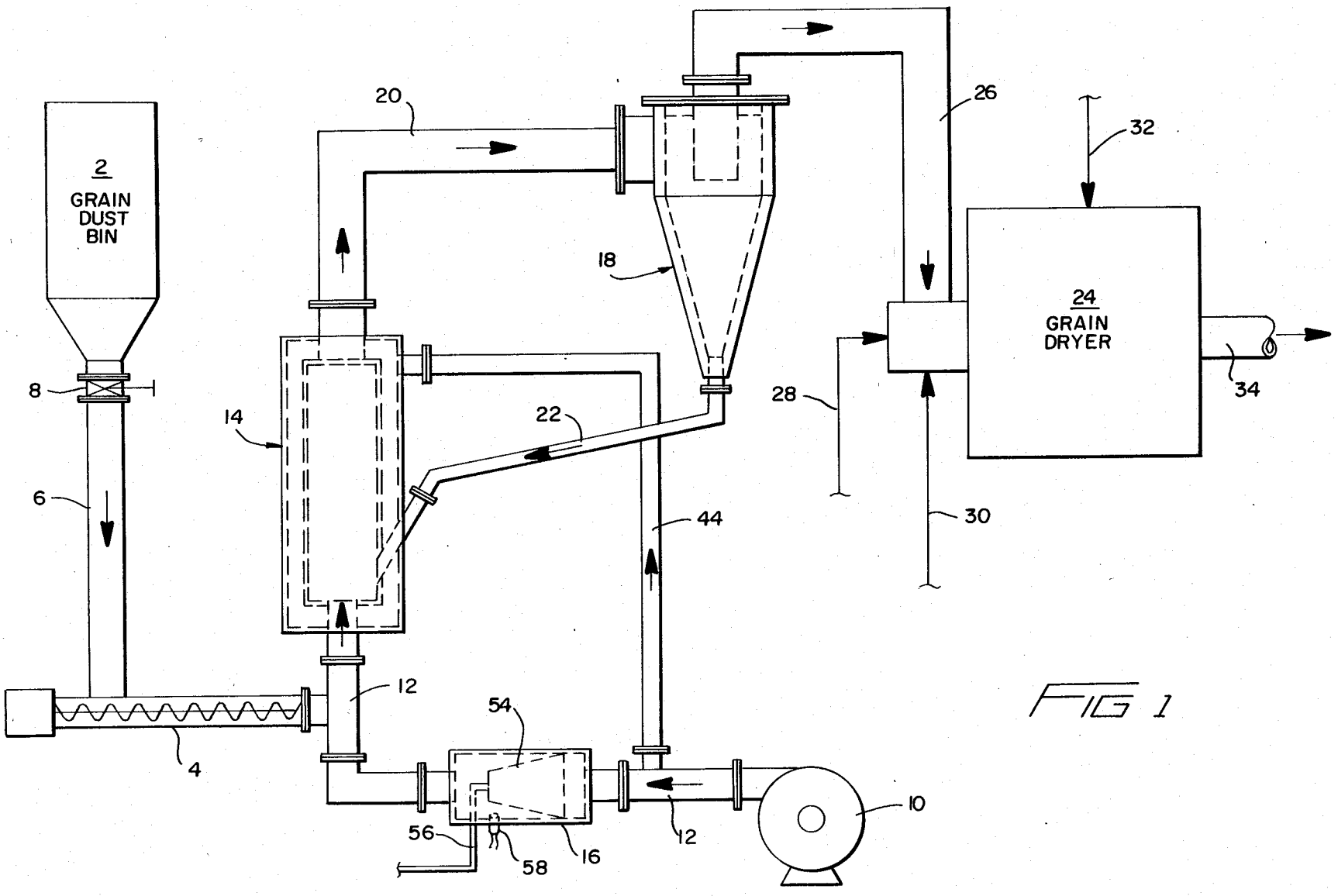
FIG. 1 is a schematic flow diagram of an apparatus in accordance with the invention.

With reference to FIG. 1, grain dust is stored in a bin 2 which communicates with a feeding auger 4 by way of a conduit 6 and valve 8. Grain dust from bin 2 is mixed with air from a blower 10 at a "T" connection in a conduit 12 prior to introduction of the mixture into a combustion means 14. Combustion means 14 includes a fluidized bed which will be described with reference to FIG. 2, and this fluidized bed is initially heated to a combustion temperature by hot gases from a start-up burner 16, which lies in conduit 12. Start up burner 16 heats the gases flowing in conduit 12 to provide a fluidized bed temperature of approximately 1000° F. Hot gases from combustion means 14 are directed to a cyclone 18 by way of conduit 20. Cyclone 18 separates hot gases from particles and returns the particles to the fluidized bed by way of conduit 22. Hot gases from the combustion of the grain dust are supplied to a known grain dryer 24 by way of conduit 26.

Additional air is added to the grain dryer by conduit 28, and natural gas or propane may be added during start up by conduit 30. Grain to be dried such as corn, is introduced at 32. Flue 34 allows the egress of hot gases after the drying process.

Figure 2:
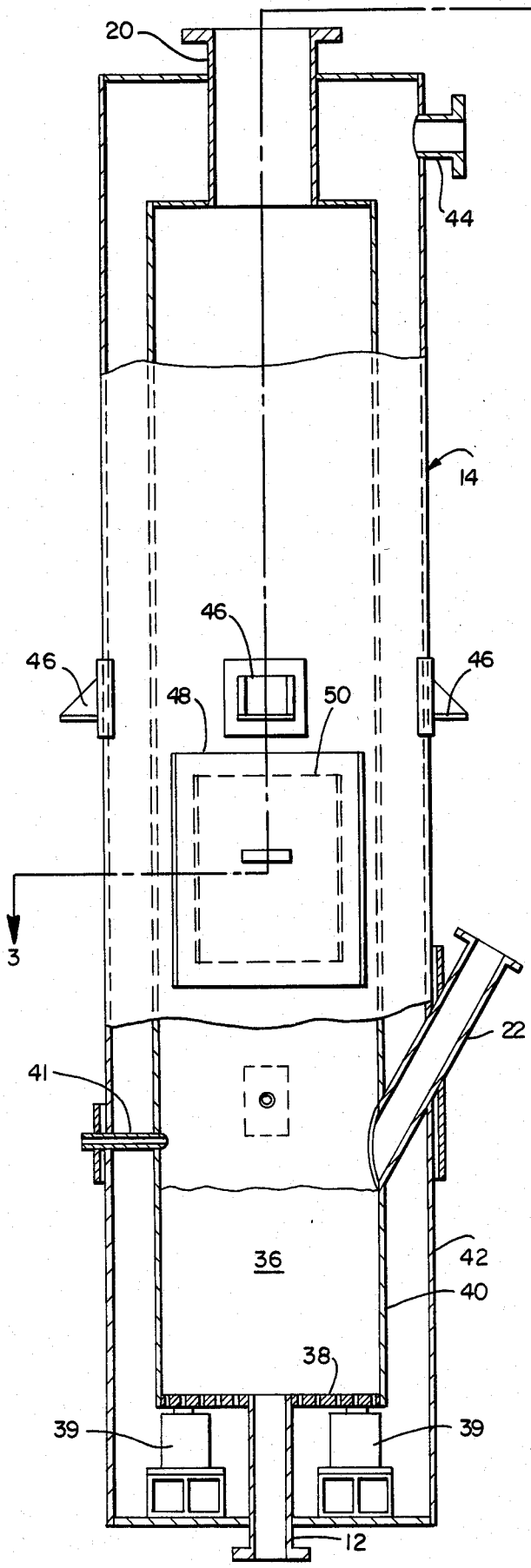
FIG. 2 is a side view, partially in cross section of a combustion apparatus in accordance with the invention.
Figure 3:
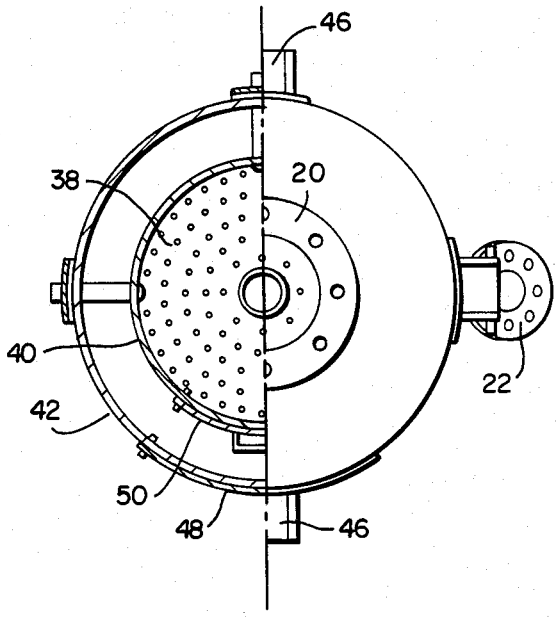
FIG. 3 is a top view, partially in cross section taken along line 3—3 of FIG. 2.

The combustion means 14 will now be described with respect to FIG. 2. A fluidized bed 36 is supported on an apertured plate 38. The fluidized bed preferably comprises sand, but may be of other materials. Combustion means 14 is preferably cylindrical and includes an inner cylindrical wall 40 supported by blocks 39 and an outer cylindrical wall 42. Inner wall 40 forms a container for the fluidized bed at a lower portion and a combustion chamber in the portion above the fluidized bed 36. Pipe 41 extends through inner and outer walls to provide a port for a probe, or the like. Air and grain are introduced through conduit 12 at a rate adequate to fluidize the sand in fluidized bed 36 and to promote combustion of grain dust from bin 2. Fluidized bed 36 is raised to combustion temperature during start-up by the provision of hot gases from start-up burner 16. Gases are produced by the combustion of grain dust in fluidized bed 36, and they rise through the cylinder formed by inner wall 40 and continue the combustion process. Then, the hot gases exit through conduit 20 and are directed to cyclone 18.

Additional air is added to fluidized bed 36 to promote combustion and to insure that the bed is in a fluidized condition. This air is obtained from blower 10 and is introduced to the combustion means by way of conduit 44 which is connected to the outer wall 42 at an upper portion thereof. Air from conduit 44 passes along the exterior of inner wall 40 in a reverse-flow before being introduced to the fluidized bed through apertured plate 38. This arrangement pre-heats air from conduit 44 because of its contact with inner wall 40 which is heated by the passage of the combustion gases.

In a preferred embodiment, air is introduced to the fluidized bed at a rate of about 3220 pounds per hour, and grain dust is supplied at a rate of about 150 pounds per hour.

Combustion means 14 is supported at brackets 46 in a known manner. Clean-out opening 48 is bolted to the exterior of outer wall 42, and clean-out opening 50 is bolted to the inner wall.

After the combustion gases have passed through the chamber formed by inner wall 40, they are directed through conduit 20 to cyclone 18. Cyclone 18 separates gases from particulate matter, such as ash, in a manner which is known in the art. The separated particulate matter is then directed from the bottom of cyclone 18 through conduit 22 into fluidized bed 36. Conduit 22 preferably passes through inner and outer walls 40 and 42 at an angle of approximately 30°.

Figure 5:
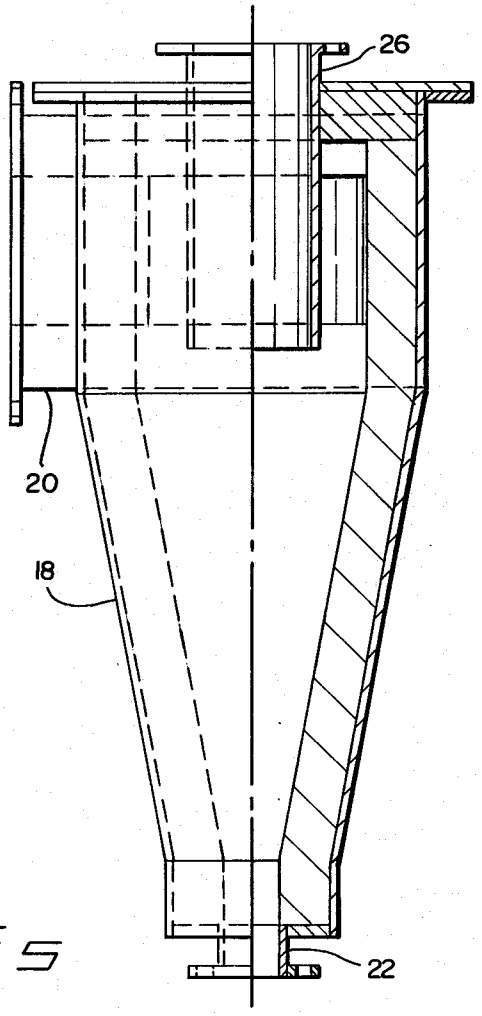
FIG. 5 is a side view of a cyclone, partially in cross section, used in the preferred embodiment of the apparatus of FIG. 1.

FIG. 5 shows the preferred structure of cyclone 18. Gases and particulate matter are introduced at 20 in a tangential direction, thus allowing the particulate matter to be thrown to the exterior of a cone and to fall to the bottom of the cone and enter conduit 22.

Figure 4:
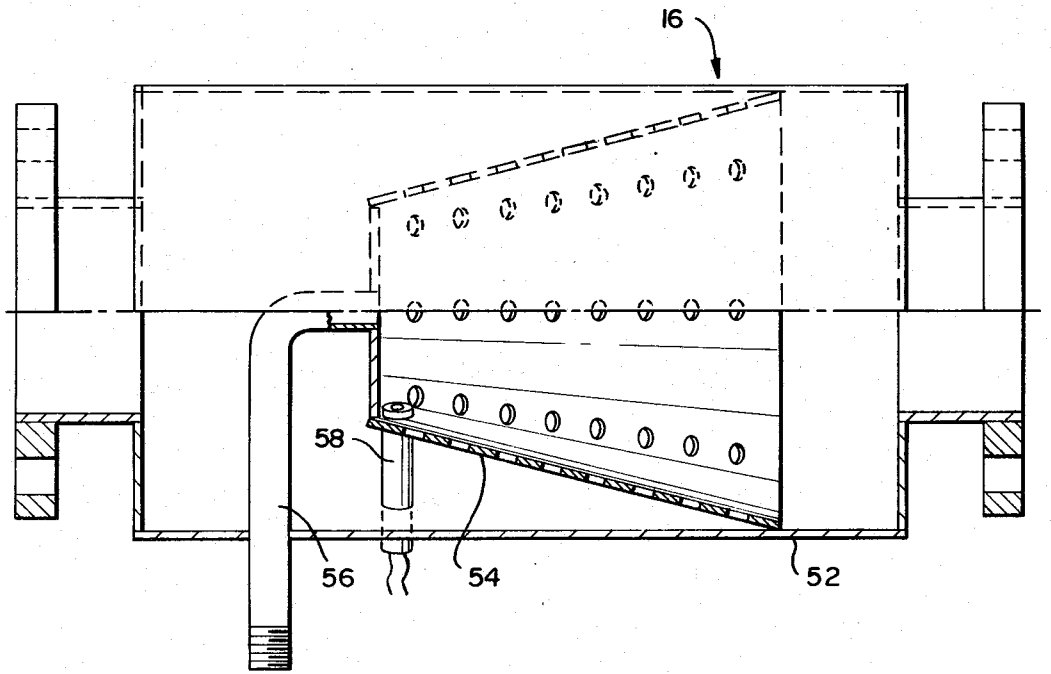
FIG. 4 is a side view, partially in cross section, of a start up burner is accordance with the invention.

FIG. 4 is a partial cross section of a preferred start up burner. A cylindrical housing 52 supports a conical, apertured element 54 which has a gas, propane, or oil tube 56 including a nozzle (not shown) at an end thereof. Igniter 58 ignites the propane or gas, and the apertures promote mixing of the burning gases with air from blower 10. As noted above, these hot gases are directed into the fluidized bed 36 to heat it to a desired temperature.

It will be appreciated that a unique arrangement has been described wherein a fluidized bed is used for the combustion of grain dust to produce hot gases for drying grain. Modifications within the scope of the appended claims will be apparent to those who are skilled in the art.

What is claimed is:

1. A method for drying grain comprising providing a fluidized bed, supplying a flow of air to said fluidized bed, adding grain dust to said flow of air, causing combustion of said grain dust in said fluidized bed, and directing combustion gases from said fluidized bed to a grain dryer.

2. A method according to claim 1 wherein said step of directing combustion gases includes the step of removing ash from said combustion gases prior to the introduction of said combustion gases to said grain dryer.

3. A method according to claim 2 wherein said step of removing ash comprises the step of introducing said combustion gases to a cyclone.

4. A method according to claim 1 further comprising heating air by bringing said air into thermal contact with said fluidized bed and then directing said air to said fluidized bed.

* * * * *